United States Patent [19]

Turner

[11] Patent Number: 4,469,180

[45] Date of Patent: Sep. 4, 1984

[54] WELL FLUID PRESSURE BALANCED OPERATOR FOR SUBSURFACE SAFETY VALVE

[75] Inventor: Edwin C. Turner, Houston, Tex.

[73] Assignee: Hydril Company, Los Angeles, Calif.

[21] Appl. No.: 313,380

[22] Filed: Oct. 21, 1981

[51] Int. Cl.[3] ..... E21B 43/12

[52] U.S. Cl. ..... 166/324; 166/374

[58] Field of Search ..... 166/319, 324, 332, 373, 166/374; 251/58, 62

[56] References Cited

U.S. PATENT DOCUMENTS

| | | | |
|---|---|---|---|
| 3,762,471 | 10/1973 | Mott | 166/322 |
| 3,782,461 | 1/1974 | Watkins | 166/322 |
| 3,860,066 | 1/1975 | Pearce et al. | 166/324 |
| 3,901,321 | 8/1975 | Mott | 166/373 |
| 3,993,136 | 11/1976 | Mott | 166/375 |
| 4,144,937 | 3/1979 | Jackson et al. | 166/373 |
| 4,193,450 | 3/1980 | Fisher, Jr. | 166/324 |

*Primary Examiner*—Stephen J. Novosad
*Assistant Examiner*—William P. Neuder
*Attorney, Agent, or Firm*—Dodge & Bush

[57] ABSTRACT

A surface controlled subsurface safety valve having rotatable ball-type closure elements and disclosed the tubular operator assembly is sealed to be substantially pressure balanced with respect to well fluid pressures when the ball-type closure is in either the open or closed position. Such arrangement enables the valve to be opened at a moderate control fluid pressure level with a substantial well pressure differential across the closed ball. In the disclosed tubing retrieval embodiment, an enclosed hydraulic system is used to balance the tubular operation and offset the hydrostatic head of the control fluid to enable greater setting depth.

5 Claims, 3 Drawing Figures

WELL FLUID PRESSURE BALANCED OPERATOR FOR SUBSURFACE SAFETY VALVE

DESCRIPTION

1. Technical Field

The present invention relates to the field of subsurface safety valves for use in hydrocarbon producing wells and in particular to a pressure balanced operator apparatus for a subsurface safety valve. By substantially balancing the net pressure urging on the tubular valve operator, the setting depth limitation due to the hydrostatic head of the control fluid is circumvented.

2. Background Art

A lengthy discussion of the evolution of surface controlled subsurface valves is set forth in Mott U.S. Pat. Nos. 3,901,321 and 3,993,136, which are hereby completely incorporated by this reference as if fully set forth herein. Such total incorporation by reference herein also includes any and all latter mentioned U.S. patents. These two Mott patents attempted, along with certain other Mott patents, to eliminate the need for a secondary or equalizing valve to overcome the shut-in well pressure differential when opening the valve. Generally, such equalizing valves utilize a lateral port in a tubular operator that is exposed to well pressure by a lost motion linkage prior to commencing to opening the valve closure element. For another example see, Leutwyler U.S. Pat. No. 3,741,249.

To provide pressure equalizing across the closed valve element, Mott spaced the ball closure element and seat to balance the fluid pressure urging on the ball prior to rotating the ball element open. Other Mott patents related to subsurface safety valves that should be incorporated herein include U.S. Pat. Nos. 4,026,362 and 4,042,024. Even when well fluid pressure is equalized across the flow closure element, the well fluid pressure urging on the tubular valve operator assembly remains unbalanced.

Another fluid pressure operating problem with surface controlled subsurface safety valves is the setting depth limitation which in substantial part is dictated by the hydrostatic head of the control fluid in the control line extending to the surface. This has frequently been overcome by using a second or balance control fluid line. See for example, Mott U.S. Pat. No. 3,762,471 or Lewis U.S. Pat. No. 3,509,913. Another approach to minimize the setting depth problem is disclosed in U.S. Pat. No. 3,782,461 which provides a pressurized chamber filled with compressible gas to offset the hydrostatic head of the control fluid.

DISCLOSURE OF THE INVENTION

In accordance with the present invention, a surface controlled subsurface safety valve is provided in which the shut-in pressure of the well urging on the valve operator is balanced for ease of opening operation. By substantially balancing the forces created by the well pressure and friction, the control fluid pressure responsive area of the operator for opening the valve can be reduced without increasing the operating pressure. Also, the reduced volume of control fluid displaced during valve operation will increase the valve's closing response time.

Further in accordance with the present invention, the hydrostatic head of the hydraulic control fluid may be substantially offset or balanced. A closed hydraulic system transmits the well fluid pressure below the closed flow control element to urge on the valve operator oppositely to the well fluid pressure. Such net balance of hydraulic forces enables the valve mechanism to be operated regardless of setting depth.

DESCRIPTION OF THE PREFERRED EMBODIMENT

Figure 1A:
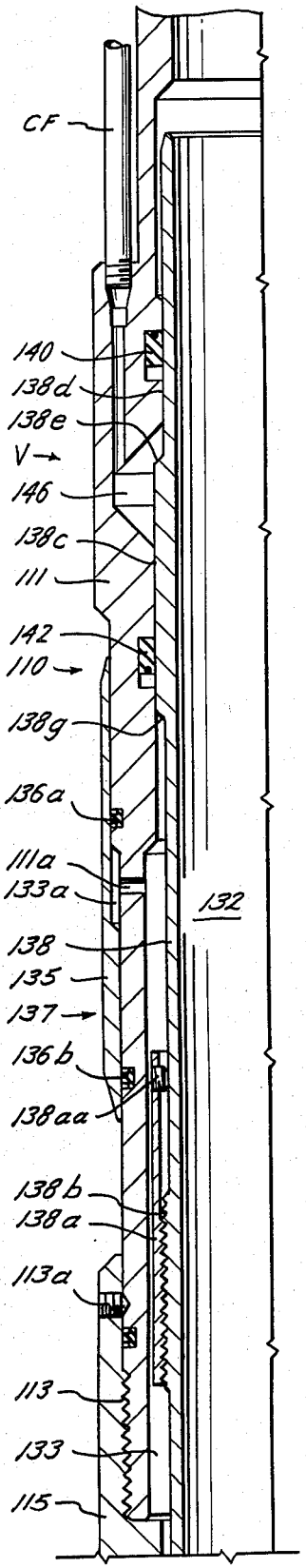
FIGS. 1A, 1B, and 1C are side views, in section, arranged in alphabetical sequence from top to bottom, of a tubing retrievable safety valve constructed in accordance with the present invention operated to the closed position.
Figure 1B:
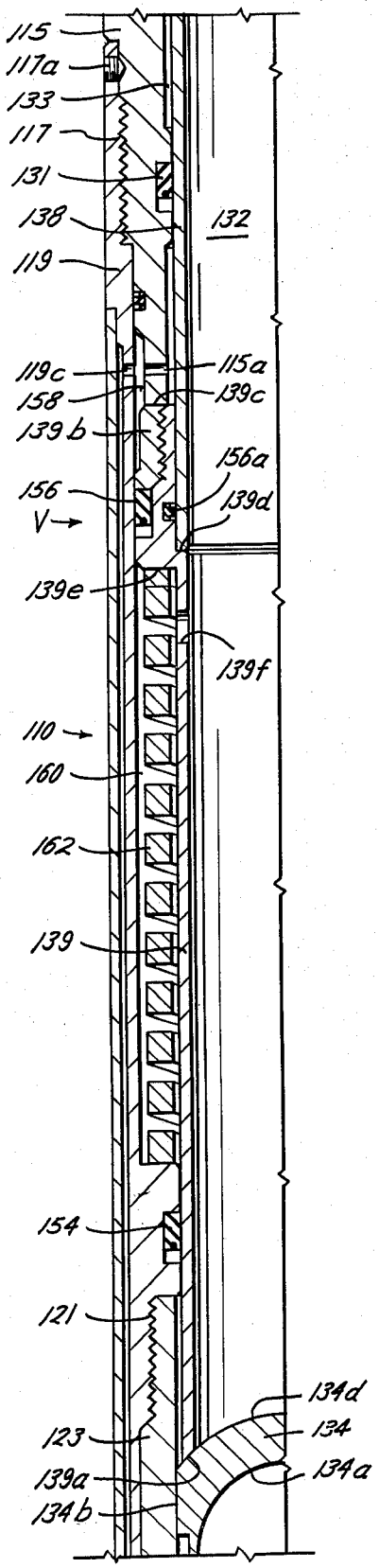
Figure 1C:
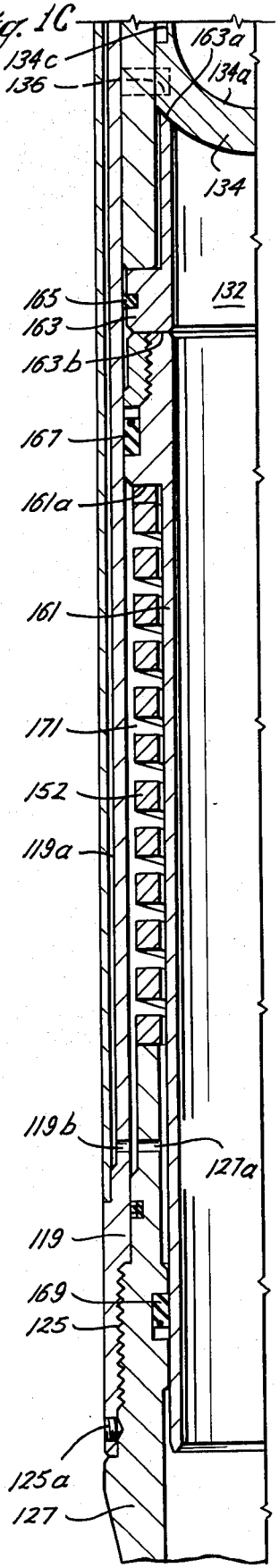

A preferred embodiment of the subsurface safety valve of the present invention, generally designated V, is illustrated in continuing sequence from top to bottom in FIGS. 1A, 1B, and 1C. This preferred embodiment, which is a tubing retrievable type subsurface safety valve V, is made up and forms a subsurface portion of the vertically disposed well tubing (not illustrated) and is therefore installed in and retrieved from a well with the well tubing. The well tubing serves to conduct the flow of well fluids upwardly from the producing formation to the wellhead in the conventional manner.

The safety valve includes a tubular valve or flow housing, generally indicated as 110, that is formed by a series of concentrically arranged tubular members for generally forming a portion of the well tubing to contain the flow of well fluids. The tubular valve or flow housing 110 is partially formed by and includes an upper housing sleeve 111 that threadedly engages at 113 with an intermediate housing sleeve 115. The upper portion of the sleeve 111 has threads (not illustrated) formed thereon for releasably securing in the conventional manner with the production or well tubing disposed above the subsurface safety valve V. The upper intermediate housing sleeve 115 threadedly engages at 117 for valve assembly purposes with a lower intermediate housing sleeve 119 (FIG. 1B). The housing sleeve 119 is in turn connected at an intermediate location by threads 121 with a longitudinally split ball closure mounting sleeve or housing sleeve 123. The lower end of the sleeve 119 (FIG. 1C) is connected by threads 125 with a lower tubular housing sub or sleeve 127 that is threadedly connected with the well tubing below the valve V in the usual manner. Suitable threaded anti-rotation pins 113*a*, 117*a*, and 125*a* may be provided to prevent inadvertent threaded disengagement of the assembled sleeves forming the tubular housing 110. Disposed in the flow enabling central flow passage or bore 132 formed by the tubular housing 110 is the ball-type flow closure element 134 that is supported by aligned pins 136 (one is illustrated in phantom in FIG. 1C) on sleeve 123 below the movable first or upper tubular operator assembly 137.

As illustrated in FIG. 1B, the movable ball-type flow closure element 134 is operably disposed within the housing sleeve 123 and is provided with a cylindrical flow port 134*a* extending therethrough. The ball or ball-type flow closure element or ball 134 is rotatable between the conventional lower open position (not illustrated) with the flow port aligned with the flow passage 132 for enabling flow and an upper closed position (FIGS. 1B and 1C) with the port 134*a* positioned transverse to the longitudinal flow passage 132 for blocking flow of fluid through the flow passage 132 and the valve V. The ball 134 is pivotally connected to the fixed housing sleeve 123 by aligned eccentric pins 136 (illustrated in phantom), in order that longitudinal movement of the ball 134 in the bore 132 will effect operating rotation of the ball 134 in a manner well known to those skilled in the art. Each of the parallel flats 134*b* formed on the ball 134 has an operating recess 134*c* formed thereon for receiving one of the two aligned pins 136 for effecting operation in a manner well known to those skilled in the art.

Disposed in the bore 132 above the rotatable ball 134 is a first or upper tubular operator assembly 137 for moving the ball 134 downwardly for effecting its opening rotation. The tubular assembly 137 is reciprocally movable in the bore 132 between a lower position (not illustrated) for positioning the ball 134 in the open position and an upper position illustrated in FIGS. 1A and 1B with the ball 134 rotated closed for blocking flow through the bore 132.

The upper valve operator assembly 137 includes an upper tubular sleeve 138 operably engaging a lower tubular sleeve 139 (FIG. 1B) that sealingly engages the outer spherical surface 134*d* of the ball element 134 with a lower arcuate fluid sealing surface 139*a*. The lower sleeve 139 includes a seal retaining ring piston 139*b* threadedly secured thereto for assembly purposes and which forms a portion of upwardly facing pressure responsive annular shoulder 139*c* which will be more fully described. The annular shoulder 139*c* also engages the housing sleeve 115 to limit upward movement or travel of the sleeve 139. The sleeve 139 also forms an upwardly facing annular shoulder 139*d* that operably engages the upper operator sleeve 138 while providing a substantially uniform constant diameter cylindrical flow passage through the upper operator assembly 137. The sleeve 139 also forms a downwardly facing pressure responsive annular surface 139*e* below the seal retaining ring 139*b* and above a pressure equalization port 139*f* formed through the sleeve 139 for communicating with the bore 132.

The upper operator sleeve 138 carries a movement limiting sleeve portion 138*a* thereon by threaded engagement at 138*b* for limiting downward movement of the sleeve 138 and assembly 137 by engagement with housing sleeve 115. The threaded engagement 138*b* is provided for ease of assembly and an anti-rotation pin 138*aa* prevents inadvertent disengagement of the threaded make-up of the threaded sleeve 138 and the movement limiting ring 138*a*. The upper sleeve 138 has a constant diameter sealing outer surface 138*c* disposed below a constant diameter sealing outer surface 138*d* of slightly smaller diameter.

The housing sleeve 111 carries a first seal assembly or seal ring 140 for effecting a sliding seal with the surface 138*d* of the sleeve 138 while a second seal assembly or seal ring 142 effects a similar sliding seal with the larger constant diameter sealing surface 138*c* of the tubular member 138. As illustrated in FIG. 1A, seal rings 140 and 142 effect sliding seals between the tubular operator sleeve 138 and the housing sleeve 111 to form an annular expansible operating chamber 146. Fluid pressure introduced into the operating expansible chamber 146 through the control fluid conduit CF from the wellhead will urge downwardly on the upwardly facing pressure responsive annular shoulder 138*e* between the sealing surfaces 138*c* and 138*d*. Fluid pressure introduced into the chamber 146 will therefore urge the operator sleeve 138 to move downwardly for moving the sleeve 139 to rotate open the ball 134 in the conventional manner.

The annular area between the fluid seal ring 142 (FIG. 1A) and the seal 131 (FIG. 1B) carried by the housing member 115 also defines an annular expansible chamber 133. Fluid pressure in the expansible chamber 133 will urge upwardly on the downwardly facing annular shoulder 138*g* of the tubular operator sleeve 138 for operably offsetting the hydrostatic head of control fluid in the control fluid conduit CF which is communicated into the operating expansible chamber 146.

Concentrically mounted outwardly of the housing sleeve 111 is a longitudinally movable piston sleeve 135 which is sealed to the housing sleeve 111 by longitudinally spaced seals 136*a* and 136*b*. These two spaced annular seals form an expansible chamber 133*a* communicating through a port 111*a* formed through the tubular member 111 for communicating with the interior annular expansible chamber 133. By completely filling the chambers 133 and 133*a* as well as the communicating port 111*a* with hydraulic fluid when assembling the valve, the hydrostatic head or pressure of the well fluid exteriorly of the well tubing in the annulus between the tubing and casing (not illustrated) will urge on the exterior piston sleeve 135 to force it to move upwardly. This will pressurize the hydraulic fluid in the expansible chamber 133*a* and 133 for urging upwardly on the shoulder 138*g* of the sleeve 138 to at least substantially offset or balance the hydrostatic head of control fluid in the conduit CF. The annular area between seals 136*a* and 136*b* can be any size, and the pressure caused by well annulus fluid will still be transmitted to shoulder 138*g*. The longitudinal spacing of 136*a* and 136*b* will only determine the travel of piston sleeve 135.

The threadedly secured seal retaining ring 139*b* secures the seal 156 with the upper operator sleeve 139 (FIG. 1B). The seal 156 effects a sliding seal with the housing sleeve 119 and defines the lower end of an annular expansible chamber 158 formed at the upper end by seal 131. The expansible chamber 158 formed by the sliding seals 131 and 156 is also enclosed by the non-sliding seal 156*a* which seals between the operator sleeve 139 and the upper operator sleeve 138 to prevent leakage of fluid therebetween. Fluid pressure in the annular expansible chamber 158 will urge downwardly on the pressure responsive annular shoulder referenced as 139*c* of the tubular operator 139 for urging a balancing downward movement of the sleeve 139 for assisting in opening the ball element 134 in a manner that will be explained in greater detail hereinafter.

The housing sleeve 119 also carries the seal 154 for effecting a sliding seal with the operator sleeve 139 that is disposed below the seal 156 carried by the operator sleeve 139 and which forms annular expansible chamber 160 between the seals. The difference in sealing diameter of the sliding seals 154 and 156 forming annular expansible chamber 160 urges upwardly on the downwardly facing pressure responsive surface or shoulder 139*e* on the operator sleeve 139. The expansible chamber 160 communicates through the port 139*f* with the interior of the tubular operator sleeve 139 above the ball 134. Well fluid pressure will therefore urge on the downwardly facing area 139*e* of the tubular operator sleeve 139 between the seals 154 and 156 for urging upward movement of the operator sleeve 139 in response to the well fluid pressure above the ball 134 introduced into the chamber 160.

A spring 162 is provided in the annular expansible chamber 160 that engages the housing sleeve 119 and the shoulder 139*e* of the operator sleeve 139 for normally urging or biasing the operator sleeve 139 to move upwardly. The upward movement or force on the tubular member 139 is transmitted through engagement by shoulder 139*d* with the upper operator sleeve 138 for moving the entire upper operator assembly 137 to the upper illustrated position. The control fluid pressure introduced into the operating chamber 146 not only must overcome the annular fluid pressure in the chamber 133 but must also overcome the well fluid pressure in the operating expansible chamber 160 as well as the urging of the spring 162 for moving the upper operator assembly 137 downwardly. The fluid pressure in the expansible chamber 158 will urge downwardly on the piston sleeve or operator sleeve 139 for assisting the operating fluid in the chamber 146 as will be described in greater detail below. By balancing or substantially offsetting the net resultant forces on the operator assembly 137, the operation of the valve V from the surface may be accomplished at any desired setting depth.

As is best illustrated in FIG. 1C, a biasing or urging spring 152 is carried by the lower housing sleeve 127 for urging the lower tubular operator 161 below the ball 134 to move upwardly. The lower tubular operator 161 engages and carries a lower ball follower member 163 carrying a felt housing wiper 165 in sliding engagement with the housing sleeve 119. The lower ball follower 163 is provided with a ball engaging arcuate surface 163*a* for moving the ball 134 upwardly to the closed position in response to the upwardly urging provided by the lower tubular operator 161 while minimizing frictional resistance of the ball 134 to closing rotation by the ball engaging surface 163*a*. An unsealed downwardly facing annular shoulder 163*b* engages the lower operator or tubular member 161 for transmitting the urging to the ball 134.

The lower operator 161 carries a seal 167 for effecting a sliding seal with the housing sleeve 119. A seal 169 carried by the housing sleeve 127 also seals with the lower operator 161 but at a smaller diameter than the seal 167. The radial difference between the seals 167 and 169 form a downwardly facing pressure responsive surface or shoulder 161*a* on the lower operator 161 which is also engaged by the spring 152 for urging on the lower operator 161. Fluid pressure in the annular expansible chamber 171 formed between the seals 167 and 169 as well as containing the spring 152 provide an upwardly urging on the operator 161 which is transmitted to the ball 134 through follower 163.

The fluid pressure in the chamber 171 as well as the urging of the spring 152 both tend to move the ball to the upper closed position. The well pressure in the bore 132 below the ball 134 tends to urge downwardly upon the upwardly facing pressure responsive shoulder 163*b* formed on the lower operator 161 between the seals 167 and 169 for urging the lower operator 161 to move downwardly. By filling the lower annular expansible chamber 171 with hydraulic fluid, the fluid pressure in the chamber 171 urging upwardly on the lower operator 161 will be made equal or fully offset the operating fluid pressure in the bore 132 urging downwardly on the lower operator 161. By communicating the chamber 171 with the annular expansible chamber 158 providing a downward urging on the upper operator sleeve 139, the pressure urging of the well fluids can be substantially offset or balanced on the valve operator assembly 137 and compensate for any frictional forces resisting opening.

To achieve that desired result, the lower expansible chamber 171 is communicated through lateral ports 127*a* and 119*b* with a longitudinally extending port 119*a* that extends upwardly to adjacent the annular expansible chamber 158. A second lateral port 119*c* communicates with the annular chamber 158 while port 115*a* assures full fluid communication to the upwardly facing pressure responsive shoulder 139*c*.

To overcome the pressure differential urging on the ball 134 when it is rotated to the closed position, the well fluid pressure below the ball 134 will also urge downwardly on the lower operator 161 for overcoming the urging of the spring 152. Such urging is transmitted by the contained hydraulic fluid contained in the expansible chamber 171 and through passageway 119*a* and ports 119*b* and 119*c* into annular expansible chamber 158. As the pressure responsive areas of the expansible chambers 158 and 171 are designed to be substantially the same, the urging of the shut-in well pressure on the closed ball 134 is effectively offset to reduce the pressure level of control fluid in the operating chamber 146 required to open the ball 134 against frictional forces and the shut-in well fluid pressure. By slightly varying the area of pressure responsive surface 161*a* and 139*c*, the offset urging on the operator assembly 137 can be precisely controlled for any particular application.

USE AND OPERATION OF THE PRESENT INVENTION

In the use and operation of the present invention, the safety valve V is assembled in the manner illustrated. The enclosed hydraulic pressure transfer systems are properly filled with a suitable hydraulic fluid during assembly. The valve is installed in a well by making up in the tubing string for positioning at a desired subsurface location in the well in the usual manner. The control fluid conduit CF which extends to the wellhead at the earth's surface is filled with control fluid for filling the opening expansible chamber 146 when the valve is being run into the well with the well tubing.

When it is desired to open the subsurface safety valve V, the pressure of the control fluid CF is increased from the earth's surface until the urging of the closing springs 162 and 152 is overcome. Because the urging of well fluid pressure on the valve operating mechanism is essentially balanced for offset in the manner previously described by the closed hydraulic systems, the safety valve V may be installed at any suitable depth in the well with a minimum of consideration of the operating effect of the hydrostatic head of control fluid in the conduit CF. Preferably, the fluid pressure in expansible chamber 133 is used to substantially offset or balance the hydrostatic head of control fluid pressure.

In the event the ball closure element 134 is shut in against well fluid and a pressure differential in the bore 132 across closed valve 134 is substantial, the offset urging the upper tubular operator assembly 137 by the well fluid pressure directly or through the hydraulic fluid on the upper tubular operator assembly 137 will help offset or assist the pressure balance of the shut-in well pressure to enable the opening of the valve V with a lower level of control fluid pressure. When the valve is moved to the open position, the well fluid pressures are also equalized on the upper tubular operator to permit easier closing which will increase the response of closing time as it is only necessary to displace a small amount of control fluid from the opening chamber 146.

The foregoing disclosure and description of the invention are illustrative and explanatory thereof, and various changes in the size, shape and materials, as well as in the details of the illustrated construction may be made without departing from the spirit of the invention.

I claim:

1. A safety valve apparatus adapted for use at a subsurface location in a hydrocarbon producing well, including:

a tubular housing having a flow passage extending longitudinally therethrough;

a flow closure element mounted with said tubular housing for movement to and from an open position for enabling flow through said flow passage and a closed position for blocking flow through said flow passage;

operator means operably connected with said flow closure element for moving said flow closure element to and from the open and closed positions, said operator means forming an expansible chamber with a pressure responsive surface for moving said flow closure element to the open position in response to a controlled fluid pressure in said expansible chamber;

means for urging said operator means to move said flow closure element to the closed position;

means for substantially balancing the urging of well fluid pressure on said operator means to eliminate the effect of well fluid pressure on said operator means when operating said flow closure element;

said operator means includes a first tubular assembly movably disposed in said flow passage above said flow closure element, said first tubular assembly forming said expansible chamber and leaving said pressure responsive surface exposed to the controlled fluid pressure for moving said flow closure element to the open position;

said first tubular assembly forming an upwardly facing annular surface responsive to well fluid pressure;

said first tubular assembly sealing with said flow closure element in the closed position to block passage of well fluid therebetween; and means for communicating well fluid pressure to said upwardly facing annular surface responsive to well fluid pressure when said flow closure element is in the closed position.

2. A safety valve apparatus adapted for use at a subsurface location in a hydrocarbon producing well, including:

a tubular housing having a flow passage extending longitudinally therethrough;

a flow closure element mounted with said tubular housing for movement to and from an open position for enabling flow through said flow passage and a closed position for blocking flow through said flow passage;

operator means operably connected with said flow closure element for moving said flow closure element to and from the open and closed positions, said operator means forming an expansible chamber with a pressure responsive surface for moving said flow closure element to the open position in response to a controlled fluid pressure in said expansible chamber;

means for urging said operator means to move said flow closure element to the closed position;

means for substantially balancing the urging of well fluid pressure on said operator means to eliminate the effect of well fluid pressure on said operator means when operating said flow closure element;

said operator means includes a first tubular assembly movably disposed in said flow passage above said flow closure element, said first tubular assembly forming said expansible chamber and leaving said pressure responsive surface exposed to the controlled fluid pressure for moving said flow closure element to the open position;

said first tubular assembly forming an upwardly facing annular surface responsive to fluid pressure;

said first tubular assembly sealing with said flow closure element in the closed position to block passage of well fluid therebetween;

means forming an enclosed hydraulic system for transmitting well fluid pressure to said upwardly facing annular surface for balancing the urging of well fluid pressure on said first tubular assembly.

3. The safety valve apparatus as set forth in claim 2, wherein:

said means forming an enclosed hydraulic system including a first expansible chamber and a second expansible chamber, said first expansible chamber located adjacent said upwardly facing annular surface for urging thereon by fluid in said first expansible chamber;

said second expansible chamber having a piston means for separating said enclosed hydraulic system from well fluids, said piston means movably responsive to well fluid pressure; and means for communicating said first and said second expansible chamber of said enclosed hydraulic system for transmitting the urging of the well fluid pressure on said piston of said second expansible chamber to said upwardly facing annular surface of said first tubular assembly in said first expansible chamber.

4. A safety valve apparatus adapted for use at a subsurface location in a hydrocarbon producing well, including:

a tubular housing having a flow passage extending longitudinally therethrough;

a flow closure element mounted with said tubular housing for movement to and from an open position for enabling flow through said flow passage and a closed position for blocking flow through said flow passage, said flow closure element being a ball-type member having a port therethrough for rotational movement to and from the open and closed positions;

operator means operably connected with said flow closure element for moving said flow closure element to and from the open and closed positions, said operator means including a first tubular assembly movably disposed in said flow passage above said flow closure element, said first tubular assembly forming a first expansible chamber with a first pressure responsive surface for moving said flow closure element to the open position in response to fluid pressure in said first expansible chamber, said operator means forming a second expansible chamber with a second pressure responsive surface for urging on said operator means in a direction opposite the urging of fluid pressure in said first expansible chamber;

said first tubular assembly forming an upwardly facing annular surface responsive to well fluid pressure;

said first tubular assembly sealing with said flow closure element in the closed position to block passage of well fluid therebetween;

means for substantially balancing the urging of well fluid pressure on said operator means to eliminate the effect of well fluid pressure on said operator means when operating said flow closure element, including means for communicating well fluid pressure to said upwardly facing annular surface responsive to well fluid pressure when said flow closure element is in the closed position;

means for urging said operator means to move said flow closure element to the closed position; and means disposed about the exterior of said tubular housing for transmitting pressure proportional to the fluid pressure between the housing and the well casing into said second expansible chamber for urging on said operator means while blocking entry of well fluids into said second expansible chamber.

5. A safety valve apparatus adapted for use at a subsurface location in a hydrocarbon producing well, including:

a tubular housing having a flow passage extending longitudinally therethrough;

a flow closure element mounted with said tubular housing for movement to and from an open position for enabling flow through said flow passage and a closed position for blocking flow through said flow passage;

said flow closure element is a ball-type member having a port therethrough for rotational movement to and from the open and closed positions;

operator means operably connecting with said flow closure element for moving said flow closure element to and from the open and closed positions, said operator means includes a first tubular assembly movably disposed in said flow passage above said flow closure element, said first tubular passage forming a first expansible chamber with a first pressure responsive surface for moving said flow closure element to the open position in response to fluid pressure in said first expansible chamber, said operator means forming a second expansible chamber with a second pressure responsive surface for urging on said operator means in a direction opposite the urging of fluid pressure in said first expansible chamber;

said first tubular assembly forming an upwardly facing annular surface responsive to well fluid pressure;

said first tubular assembly sealing with said flow closure element in the closed position to block passage of well fluid therebetween;

means forming an enclosed hydraulic system for transmitting well fluid pressure to said upwardly facing annular surface for balancing the urging of well fluid pressure on said first tubular assembly;

said means forming an enclosed hydraulic system including a third expansible chamber and a fourth expansible chamber, said third expansible chamber located adjacent said upwardly facing annular surface for urging thereon by fluid in said third expansible chamber;

said fourth expansible chamber having a piston means for separating said enclosed hydraulic system from well fluids, said piston means movably responsive to well fluid pressure;

means for communicating said third and fourth expansible chambers of said enclosed hydraulic system for transmitting the urging of the well fluid pressure on said piston of said fourth expansible chamber to said upwardly facing annular surface of said first tubular assembly in said third expansible chamber;

means for urging said operator means to move said flow closure element to the closed position; and means disposed about the exterior of said tubular housing for transmitting pressure proportional to the fluid pressure between the housing and the well casing into said second expansible chamber for urging on said operator means while blocking entry of well fluids into said second expansible chamber.

* * * * *